US005350315A

United States Patent [19]

Cheng et al.

[11] Patent Number: 5,350,315

[45] Date of Patent: Sep. 27, 1994

[54] LAMP SOCKET FOR A CHRISTMAS TREE LIGHT

[76] Inventors: You-Jen Cheng; Tzu-Ling Cheng, both of 2nd Fl., 18-9, Tienmu W. Rd., Taipei City, Taiwan

[21] Appl. No.: 117,866

[22] Filed: Sep. 7, 1993

[51] Int. Cl.[5] ..... H01R 33/22; H01R 4/24

[52] U.S. Cl. ..... 439/419; 439/659; 439/666

[58] Field of Search ..... 439/419, 659, 661–667, 439/734, 735, 802

[56] References Cited

U.S. PATENT DOCUMENTS 1,044,192 11/1912 Frantz ..... 439/667

3,372,362 3/1968 Schick ..... 439/419

3,597,725 8/1971 Beck et al. ..... 439/419

*Primary Examiner*—Steven C. Bishop

*Attorney, Agent, or Firm*—Ladas & Parry

[57] ABSTRACT

A lamp socket comprised of a socket shell, a socket body fitted into a socket shell to hold a lamp bulb, and a mounting device fastened to the socket shell to hold the electric wire of a light string, wherein the socket shell has stop blocks to stop the socket body from rotary motion relative to the socket shell; the mounting device has bottom blocks pressed on the electric wire against the socket shell; the socket body has two opposite projecting strips inserted through holes on the socket shell and respectively bent inward to hold down the electric wire.

1 Claim, 3 Drawing Sheets

LAMP SOCKET FOR A CHRISTMAS TREE LIGHT

BACKGROUND OF THE INVENTION

The present invention relates to lamp sockets, and more particularly to a lamp socket for a Christmas tree light which is durable in use.

The type of lamp socket with which this invention is concerned, as shown in FIG. 4, includes a socket shell, a mounting device having two bottom hooks hooked in holes on the socket shell to hold down an electric wire in a wire groove on the socket shell, a socket body fitted into the socket shell to hold a lamp bulb through a screw joint permitting the lamp bulb to be electrically connected to the electric wire by the contacts being fastened inside the socket shell. Because the socket body is fastened to the socket shell simply by inserting the socket body into the socket shell by force, the socket shell may be turned relative to the socket body, causing a contact error. Further, because the electric wire is retained in the wire groove on the socket shell simply by the mounting device, it may be pulled to disconnect from the contacts easily.

SUMMARY OF THE INVENTION

The present invention eliminates the aforesaid drawbacks. According to the present invention, four stop blocks are made inside shell at four corners and respectively engaged into opposite side openings on the socket body, and therefore the socket body is prohibited from rotary motion relative to the socket shell. Two projecting strips are made on the socket body and inserted through respective holes on the socket shell and then bent inward to hold down the electric wire being inserted into the wire groove on the socket shell. Two bottom blocks are made on the mounting device at the bottom to press the electric wire against the socket shell so as to hold down the electric wire in place as the mounting device is fastened to the socket shell.

DETAILED DESCRIPTION OF THE PREFERRED EMBODIMENT

Figure 1:
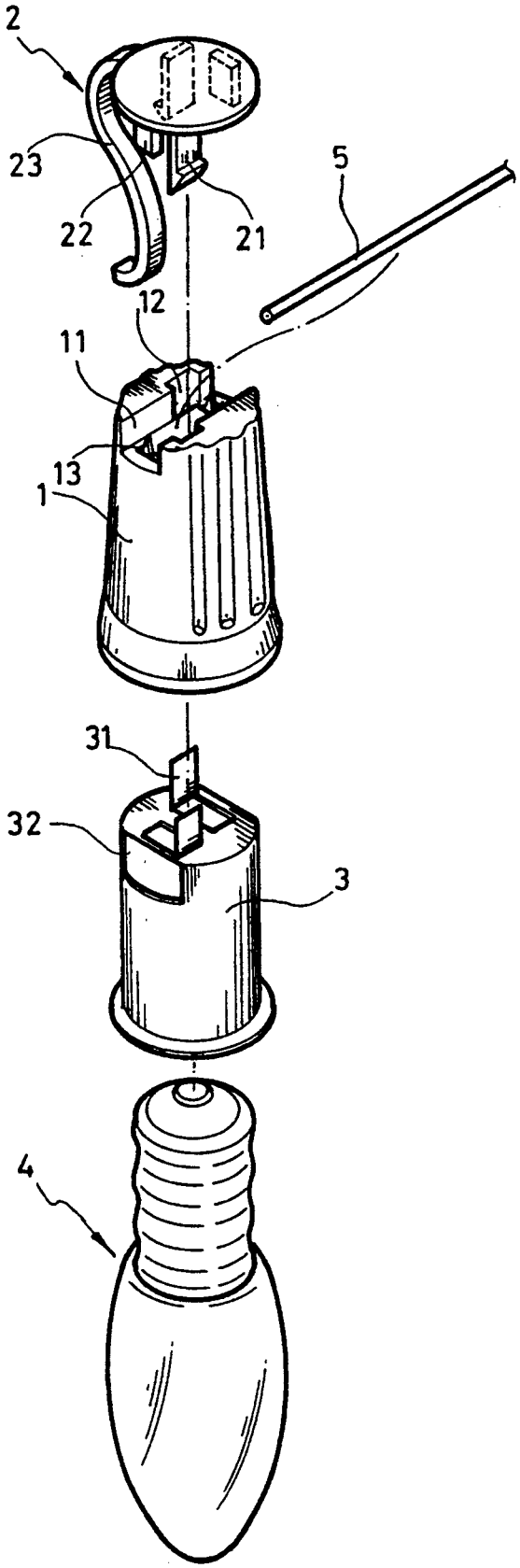
FIG. 1 is an exploded view of a lamp socket according to the preferred embodiment of the present invention.

Referring to FIG. 1, a socket lamp in accordance with the preferred embodiment of the present invention is generally comprised of a socket shell 1, a contact metal socket body 3, and a mounting device 2.

Figure 2:
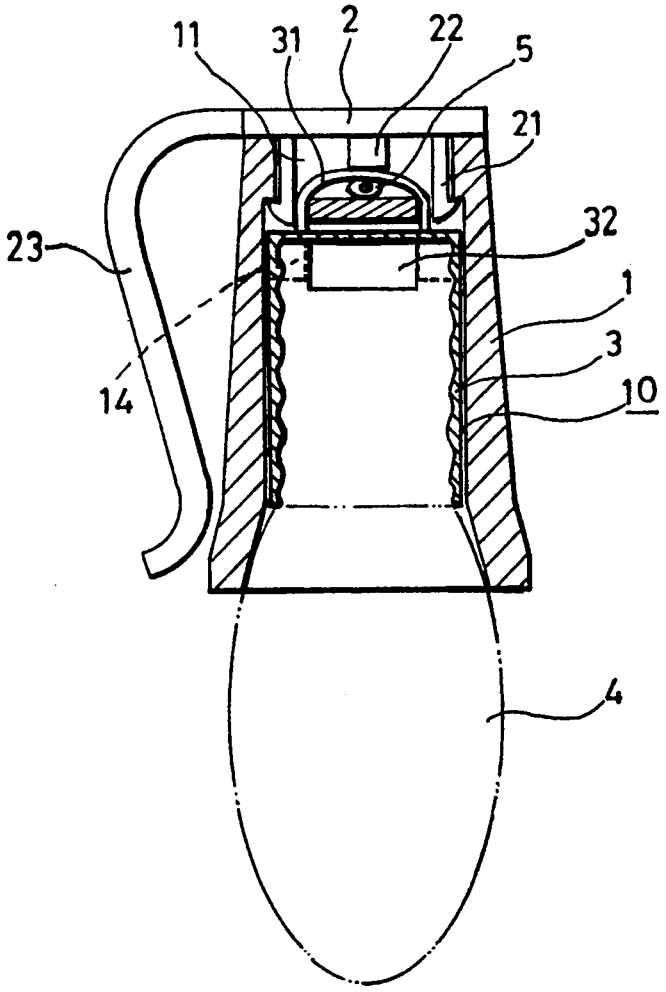
FIG. 2 is an assembly view in section of the lamp socket of FIG. 1.
Figure 3:
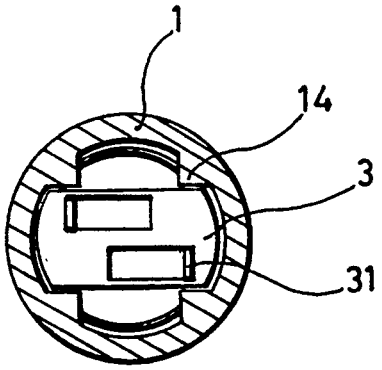
FIG. 3 is an end view in section of the lamp socket of FIG. 1 showing the socket body stopped from rotary motion.
Figure 4:
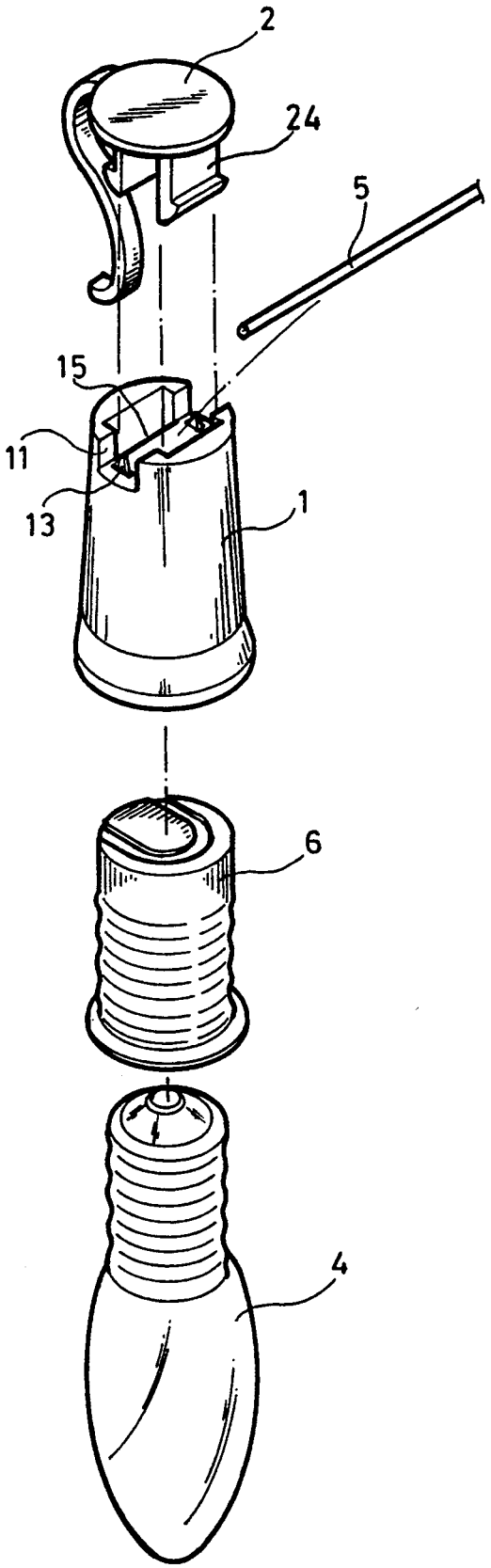
FIG.4 PRIOR ART
FIG. 4 is an exploded view of a lamp socket according to the prior art.

Referring to FIGS. 2 and 3 and FIG. 1 again, the socket shell 1 comprises a recessed hole 10 on one end thereof, four stop blocks 14 at four corners on the bottom within the recessed hole 10, a wire groove 11 through an opposite end thereof on the outside, two slots 12 longitudinally disposed at two diagonal corners on two opposite sides by the wire groove 11 and communicated with the recessed hole 10, two pointed metal contacts 13 fastened inside the recessed hole 10 and projected over the wire groove 11. The contact metal socket body 3 fits into the recessed hole 10 of the socket shell 1 for holding a lamp bulb 4 through a screw joint (the contact metal socket body 3 connects the ring contact and tip contact of the lamp bulb 4 to the two pointed metal contacts 13 electrically as the lamp bulb 4 is threaded into the contact metal socket body 3), comprising opposite side openings 32 respectively stopped by the stop blocks 14 from rotary motion (see FIG. 3), two projecting strips 31 inserted through the slots 12 on the socket shell 1 and respectively bent inwards to hold down the electric wire 5 being inserted into the wire groove 11.

Referring to FIGS. 1 and 2 again, the mounting device 2 is made in the shape of a disk comprising two bottom hooks 21 respectively hooked in the slots 12, two opposite bottom blocks 22 respectively pressed on the electric wire 5, and a clamp 23 for fastening the lamp socket to a Christmas tree. As the mounting device is fastened to the socket shell 1 with the bottom blocks 22 stopped against the electric wire 5, the pointed tip of each contact metal 13 is forced to pierce into the electric wire 5 and then to make a contact electrically.

What is claimed is:

1. A lamp socket comprised of a socket shelf, a mounting device fastened to said socket shell on the outside through hooked joints to hold an electric wire, a socket body fitted into said socket shell to hold a lamp bulb through a screw joint permitting the lamp bulb to be electrically connected to the electric wire, wherein said socket shell comprises four stop blocks on the inside at four corners respectively engaged into two opposite openings on said socket body to stop said socket body from rotary motion relative to said socket shell; said mounting device comprises two bottom blocks pressed oil the electric wire against said socket shell; said socket body comprises two opposite projecting strips inserted through holes on said socket shell and respectively bent inward to hold down the electric wire.

* * * * *